US010354475B2

(12) United States Patent
Longman

(10) Patent No.: US 10,354,475 B2
(45) Date of Patent: Jul. 16, 2019

(54) VENDING MACHINES

(71) Applicant: Red Bull GmbH, Fuschl Am See (AT)

(72) Inventor: Daniel Longman, Leicester (GB)

(73) Assignee: RED BULL GMBH, Fuschl Am See (AT)

( * ) Notice: Subject to any disclaimer, the term of this patent is extended or adjusted under 35 U.S.C. 154(b) by 0 days.

(21) Appl. No.: 15/302,686

(22) PCT Filed: Mar. 27, 2015

(86) PCT No.: PCT/GB2015/050936
§ 371 (c)(1),
(2) Date: Oct. 7, 2016

(87) PCT Pub. No.: WO2015/155506
PCT Pub. Date: Oct. 15, 2015

(65) Prior Publication Data

US 2017/0032607 A1 Feb. 2, 2017

(30) Foreign Application Priority Data

Apr. 7, 2014 (GB) ..... 1406211.1

(51) Int. Cl.
*G07F 11/10* (2006.01)
*G07F 11/16* (2006.01)
*G07F 11/42* (2006.01)

(52) U.S. Cl.
CPC ..... *G07F 11/10* (2013.01); *G07F 11/16* (2013.01); *G07F 11/165* (2013.01); *G07F 11/42* (2013.01)

(58) Field of Classification Search
CPC ..... G07F 11/10; G07F 11/16; G07F 11/26; G07F 11/42; G07F 11/62
See application file for complete search history.

(56) References Cited

U.S. PATENT DOCUMENTS 2,286,905 A * 6/1942 Gabrielsen ..... G07F 11/06 221/124
2,816,688 A * 12/1957 Wolf ..... G07F 11/045 221/155

(Continued)

FOREIGN PATENT DOCUMENTS

| | | | |
|---|---|---|---|
| DE | 19946609 | A1 | 4/2001 |
| EP | 1460595 | A1 | 9/2004 |
| WO | 0060554 | A2 | 10/2000 |

OTHER PUBLICATIONS

ISA/EP, International Search Report and Written Opinion for PCT patent application No. PCT/GB2015/050936, dated Jul. 6, 2015.

*Primary Examiner* — Gene O Crawford
*Assistant Examiner* — Kelvin L Randall, Jr.
(74) *Attorney, Agent, or Firm* — NK Patent Law

(57) ABSTRACT

A product transport mechanism is provided for a vending machine which has a product storage area, comprising a plurality of vertically spaced product storage locations, and a product collection area. The product transport mechanism comprises a plurality of vertically arranged product transport carriages. Each product transport carriage is movable in the same vertical plane between: a first position in which it is arranged to receive a product dispensed from a predetermined one of the vertically spaced product storage locations; and a second position below the first position in which the product transport carriage is located in the product collection area to enable collection of the vended product. Each product transport carriage is arranged to nest with the product transport carriage immediately below it so that more than one of the product transport carriages can simultaneously adopt the second position in the product collection area.

21 Claims, 13 Drawing Sheets

(56) References Cited

U.S. PATENT DOCUMENTS

| | | | | | |
|---|---|---|---|---|---|
| 3,608,775 | A * | 9/1971 | Offutt | A47F 3/08 | 221/84 |
| 3,616,965 | A * | 11/1971 | Bendl | G07F 11/58 | 108/94 |
| 4,252,250 | A | 2/1981 | Toth | | |
| 6,283,324 | B1 * | 9/2001 | Jenkins | B65G 1/08 | 221/192 |
| 6,505,755 | B1 * | 1/2003 | Voss | G07D 11/0003 | 209/534 |
| 9,087,440 | B2 * | 7/2015 | Gao | G07F 11/38 | |
| 2002/0145003 | A1 * | 10/2002 | Nicolini | G07F 11/32 | 221/191 |
| 2008/0011771 | A1 * | 1/2008 | Roekens | G07F 11/24 | 221/253 |
| 2011/0240569 | A1 * | 10/2011 | Kahl | A47F 1/125 | 211/4 |

* cited by examiner

VENDING MACHINES

TECHNICAL FIELD

The present disclosure relates generally to vending machines. Embodiments of the present disclosure relate in particular to a product transport mechanism for a vending machine and/or to a vending machine door panel comprising a product transport mechanism and/or to a vending machine comprising a product transport mechanism.

TECHNICAL BACKGROUND

Vending machines are used in a wide range of locations to vend a wide variety of products to consumers. A selection of different products is typically stored in a product storage area of the vending machine at vertically spaced product storage locations which are positioned one above the other. Each vertically spaced product storage location normally has an array of substantially horizontal files of products extending between the front and rear of the vending machine and positioned adjacent to each other across the width of the vending machine.

The products in each horizontal file are arranged on a product support, such as a shelf or magazine, and the products are normally dispensed from each file at the front, for example by a pusher or by a spiral drive. After a product has been selected and purchased by a customer, for example using a selection device such as a keypad on the front of the vending machine, it is dispensed from the appropriate one of the horizontal files in the product storage area and is delivered to a product collection area where it can be collected by the customer.

The product collection area is normally positioned below the product storage area towards the bottom of the vending machine and products are often delivered to the product collection area by simply allowing a dispensed product to fall under the influence of gravity. Allowing products to fall in this way, in a relatively uncontrolled manner, can be problematic particularly when the products are delicate and especially when the products are stored at product storage locations at an upper region of the product storage area towards the top of the vending machine. In the case of carbonated beverages stored in cans or bottles for example, if a dispensed can or bottle is simply allowed to fall under the influence of gravity from a product storage location at an upper region of the product storage area into the product collection area at the bottom of the vending machine, the carbonated beverage will be agitated and will tend to fizz excessively if the can or bottle is opened immediately. The customer may, therefore, have to wait for a short time before they can consume the carbonated beverage.

One way of addressing this problem is to provide a combination vending machine in which products such as snack foods and confectionery are stored at the product storage locations in the upper region of the product storage area whilst carbonated beverages are stored at the product storage locations in the lower region of the product storage area, for example on the two lowest shelves or magazines. Because a carbonated beverage only has to fall a short distance into the product collection area when it is released from a relatively low product storage location, it is only minimally agitated and therefore tends not to fizz excessively when opened immediately after purchase. This solution is, however, only feasible if the vending machine is sited in a location where both snack foods/confectionery products and carbonated beverages are likely to be consumed.

Another way of addressing this problem is to use an xyz-picker to individually retrieve a purchased product such as a carbonated drink from one of the product storage locations in the product storage area and to deliver it in a controlled manner to the product collection area. Known xyz-pickers, and hence the vending machines into which they are incorporated, tend to be complex and expensive and this can make them an unattractive proposition.

There is, therefore, a need for an improved product transport mechanism for a vending machine which overcomes the disadvantages mentioned above.

SUMMARY OF THE DISCLOSURE

According to a first aspect of the present disclosure, there is provided a product transport mechanism for a vending machine having a product storage area comprising a plurality of vertically spaced product storage locations and a product collection area, the product transport mechanism comprising:

- a plurality of vertically arranged product transport carriages each of which is movable in the same vertical plane between: a first position in which the product transport carriage is arranged to receive a product dispensed from a predetermined one of the vertically spaced product storage locations; and a second position below the first position in which the product transport carriage is located in the product collection area to enable collection of the vended product by a customer from the product transport carriage;
- each product transport carriage being arranged to nest with the product transport carriage immediately below it so that more than one of the product transport carriages can simultaneously adopt the second position in the product collection area.

According to a second aspect of the present disclosure, there is provided a vending machine door panel for a vending machine having a product storage area comprising a plurality of vertically spaced product storage locations and a product collection area, the vending machine door panel incorporating a product transport mechanism according to the first aspect of the present disclosure.

According to a third aspect of the present disclosure, there is provided a vending machine having a product storage area comprising a plurality of vertically spaced product storage locations and a product collection area located below the product storage area for collection of a vended product by a customer, wherein the vending machine includes a product transport mechanism comprising:

- a plurality of vertically arranged product transport carriages each of which is movable in the same vertical plane between: a first position in which the product transport carriage is arranged to receive a product dispensed from a predetermined one of the vertically spaced product storage locations; and a second position below the first position in which the product transport carriage is located in the product collection area to enable collection of the vended product by a customer from the product transport carriage;
- each product transport carriage being arranged to nest with the product transport carriage immediately below it so that more than one of the product transport carriages can simultaneously adopt the second position in the product collection area.

Aspects of the present disclosure provide the advantage that the product transport carriages transport products in a controlled manner from the product storage area to the product collection area. Delicate products can, therefore, be stored at the uppermost vertically spaced product storage locations in the product storage area and can be transported in a controlled manner to the product collection area. For example, carbonated beverages can be transported by the product transport carriages from the uppermost product storage locations in the product storage area to the product collection area with minimal agitation of the contents. A vended carbonated beverage can, thus, be opened immediately by a customer without the risk of excess fizzing. Because each product transport carriage simply nests with the product transport carriage immediately below it when the product transport carriages are in the second position, a separate product transport carriage can be provided to transport products from each of the vertically spaced product storage locations in the product storage area to the product collection area below.

Each product transport carriage may be substantially vertically aligned with a predetermined one of the vertically spaced product storage locations when each product transport carriage is in its first position. This ensures that each product transport carriage can readily receive a product dispensed from the predetermined product storage location with which it is vertically aligned.

Each product transport carriage may include front and rear lips to retain a product dispensed from one of the product storage locations onto the product transport carriage. Each product transport carriage may extend in use across the front of the vending machine, for example across the entire width of the product storage area. Each product transport carriage can, thus, receive a product dispensed from an array of substantially horizontal files of products extending between the front and rear of the vending machine and positioned adjacent to each other across the width of the product storage area. Each product transport carriage may comprise a substantially horizontal shelf member.

The product transport mechanism may comprise left and right vertically extending belts at each end of the product transport carriages. The left and right belts may together control the movement of the product transport carriages between the first and second positions. The term 'belt' in this specification is intended to include not only a belt in the strict sense, but also a chain, a wire, a cable, a cord, a rope and similar functionally equivalent components.

Each of the left and right belts may extend respectively around left upper and lower sprockets and right upper and lower sprockets. The left and right belts may include formations which cooperate with tooth formations on the left and right upper and lower sprockets. The left and right belts could be endless belts.

The left and right upper sprockets may be mounted at opposite ends of an upper shaft. The left and right lower sprockets may be mounted at opposite ends of a lower shaft. By mounting the left and right upper sprockets and the left and right lower sprockets on common upper and lower shafts, the movement of the left and right sprockets on each shaft is synchronised. This ensures that the movement of the left and right belts is synchronised and hence that the product transport carriages can be maintained in a substantially horizontal orientation as they move between the first and second positions. Maintaining a horizontal orientation and avoiding tilting may help to facilitate nesting of the product transport carriages when more than one of the product transport carriages are in the second position in the product collection area.

Each product transport carriage may include left and right openings at its left and right ends. The left and right belts may pass freely through the respective left and right openings. Each of the left and right openings in each product transport carriage may be larger than the corresponding left and right openings in the product transport carriage immediately above it. For example, the principal horizontal dimension of the left and right openings in each product transport carriage may be larger than the corresponding principal horizontal dimension of the left and right openings in the product transport carriage immediately above it. The largest left and right openings are therefore provided in the lowest product transport carriage and the smallest left and right openings are provided in the uppermost product transport carriage.

Horizontal pairs of vertically spaced carriage support members may be fixed to the left and right belts. Each horizontal pair of left and right carriage support members may be positioned below a predetermined one of the product transport carriages to support the product transport carriage on the left and right belts and prevent it from sliding downwardly along the belts.

Each horizontal pair of left and right carriage support members may be fixed to the left and right belts at a predetermined vertical position whereby each of the product transport carriages can be simultaneously substantially vertically aligned in use with a predetermined one of the vertically spaced product storage locations to receive a product dispensed therefrom.

Each horizontal pair of left and right carriage support members may be larger than the corresponding left and right openings in the predetermined product transport carriage which is supported by the carriage support members. This ensures that the left and right carriage support members cannot pass through the left and right openings in the predetermined product transport carriage which is supported by the horizontal pair of carriage support members and that the product transport carriage cannot slide down over the left and right carriage support members. For example, each horizontal pair of left and right carriage support members may have a principal horizontal dimension which is larger than the principal horizontal dimension of the corresponding left and right openings in the predetermined product transport carriage which is supported by the horizontal pair of carriage support members.

The horizontal pair of left and right carriage support members supporting a product transport carriage may be smaller than the corresponding left and right openings in the product transport carriages below the product transport carriage supported by said horizontal pair of left and right carriage support members. For example, the principal horizontal dimension of the horizontal pair of left and right carriage support members supporting a product transport carriage may be smaller than the principal horizontal dimension of the corresponding left and right openings in the product transport carriages below the product transport carriage supported by said horizontal pair of left and right carriage support members. This means that when the lowest product transport carriage has moved downwardly from its first position to the second position in the product collection area, one or more of the product transport carriages above it can also move from their first positions to the second position because the left and right carriage support members supporting each of the one or more product transport carriages can pass through the larger left and right openings in the product transport carriage(s) below it.

Each carriage support member may have a substantially circular cross-section and may be substantially cylindrical. The principal horizontal dimension may thus be the diameter of the carriage support member. Similarly, each of the left and right openings may have a substantially circular cross-section. The principal horizontal dimension may thus be the diameter of the substantially circular left and right openings. Other shapes could be adopted for the carriage support members and for the left and right openings. It is merely sufficient that the cross-sectional shapes of the carriage support members and the left and right openings are generally the same, albeit of different sizes as defined above. For example, the carriage support members could be rectangular and the left and right openings could likewise be rectangular; the carriage support members could be spherical and the left and right openings could be circular.

Each carriage support member may include a channel to enable it to pass around the lower sprockets during movement of the left and right belts around the lower sprockets.

Each of the product transport carriages may adopt its respective first position when the product transport carriages are unloaded, i.e. when not loaded by a product dispensed from one of the vertically spaced product storage locations in the product storage area of the vending machine. Thus, each of the product transport carriages is always ready to receive a product dispensed from its corresponding product storage location.

Each of the left and right belts may include a counterweight and the counterweights may be arranged to move the left and right belts to position each of the product transport carriages in its respective first position when the product transport carriages are unloaded. This provides a simple but effective way of returning the product transport carriages to their respective first positions, for example after a product has been transported to the product collection area by one of the product transport carriages and removed by a customer from the product transport carriage.

The product transport mechanism may include a damper arrangement to retard the movement of the product transport carriages between the first and second positions. The product transport carriages thus descend in a controlled manner from the first position to the second position when a product has been dispensed onto one of the product transport carriages. Likewise, the product transport carriages ascend to their respective first positions in a controlled manner after a product transported to the product collection area by one of the product transport carriages has been removed by a customer.

The product transport mechanism may include a motorised drive unit to control the movement of the product transport carriages between the first and second positions. The motorised drive unit could be adapted to rotate the upper shaft or the lower shaft. For example, the motorised drive unit could include a rotating drive member which engages and rotates a rotatable member mounted on the upper or lower shaft.

The door panel and/or the vending machine may further comprise an access cover which may be movable between a closed position and an open position to allow a customer to access the product collection area to retrieve a product from a product transport carriage in the second position and may include a braking mechanism which is operable to prevent movement of the product transport carriages when the access cover is in the open position. Such an arrangement is particularly advantageous in embodiments where counterweights are fitted to the left and right belts to return the product transport carriages to their respective first positions. In particular, when a customer has opened the access cover to remove a product from a product transport carriage which is in the second position, the product having been transported from the product storage area to the product collection area by the product transport carriage, the operation of the braking mechanism upon opening the access cover ensures that the product transport carriages cannot move upwardly to their respective first positions. The customer's hand cannot, therefore, be trapped or injured by a moving product transport carriage since the product transport carriages can only move when the access cover is in the closed position, and hence when the braking mechanism is inoperative.

DETAILED DESCRIPTION OF EMBODIMENTS

Embodiments of the present disclosure will now be described by way of example only and with reference to the accompanying drawings.

Figure 1A:
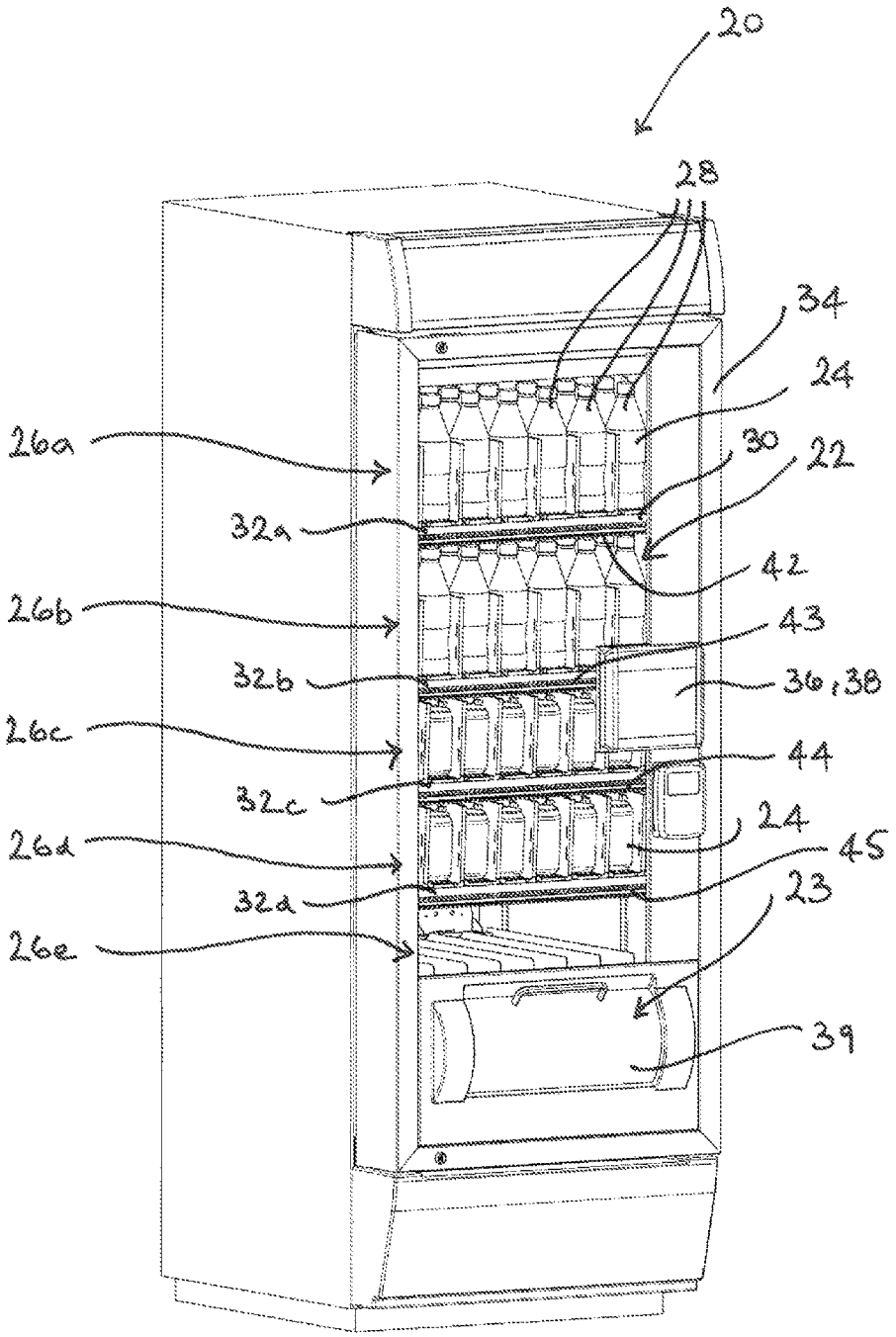
FIG. 1*a* is a diagrammatic perspective view of a vending machine which has a door panel incorporating a product transport mechanism according to embodiments of the present disclosure.
Figure 1B:
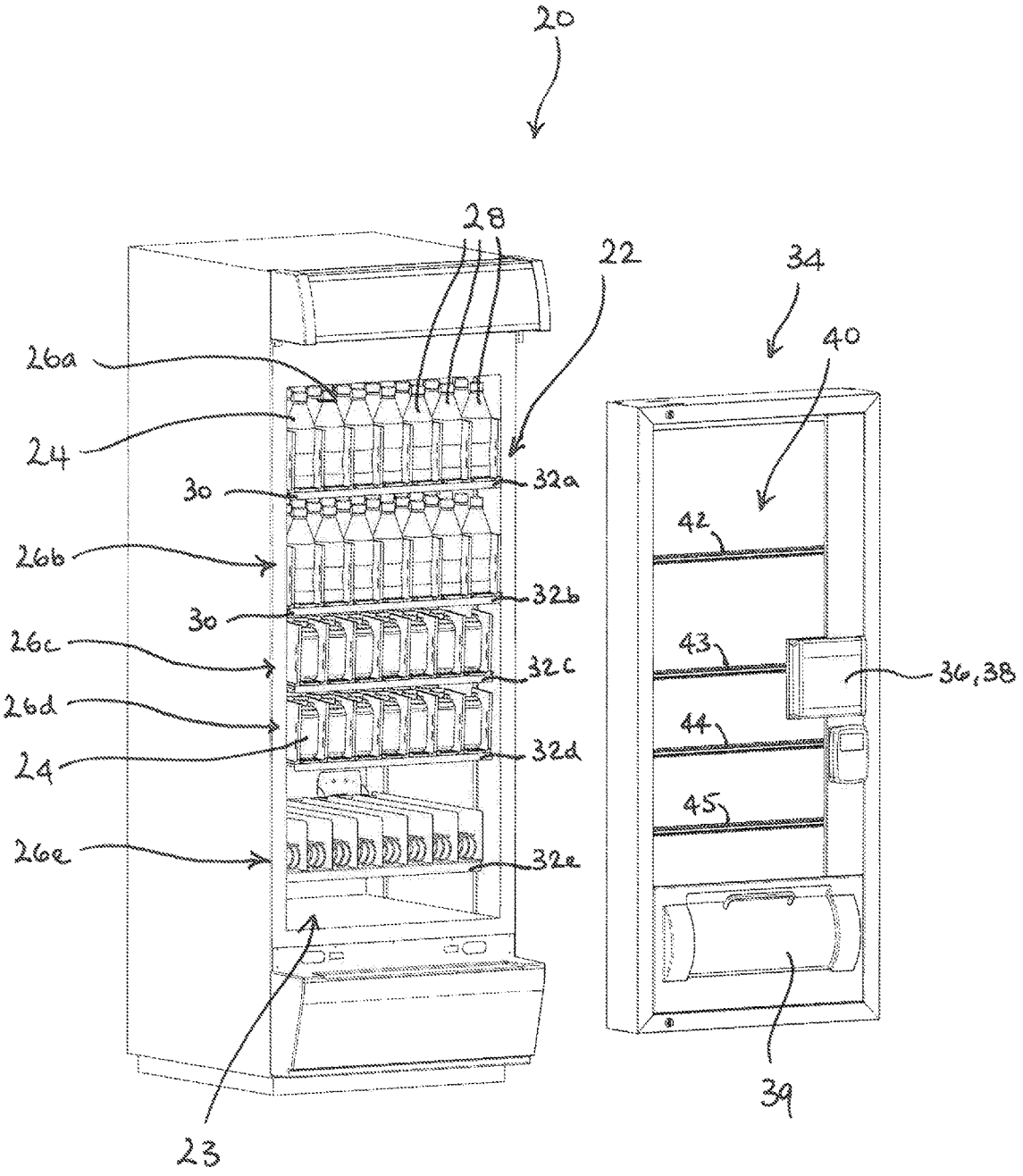
FIG. 1*b* is an exploded view of the vending machine of FIG. 1*a* showing the door panel separated from the vending machine.
Figure 2:
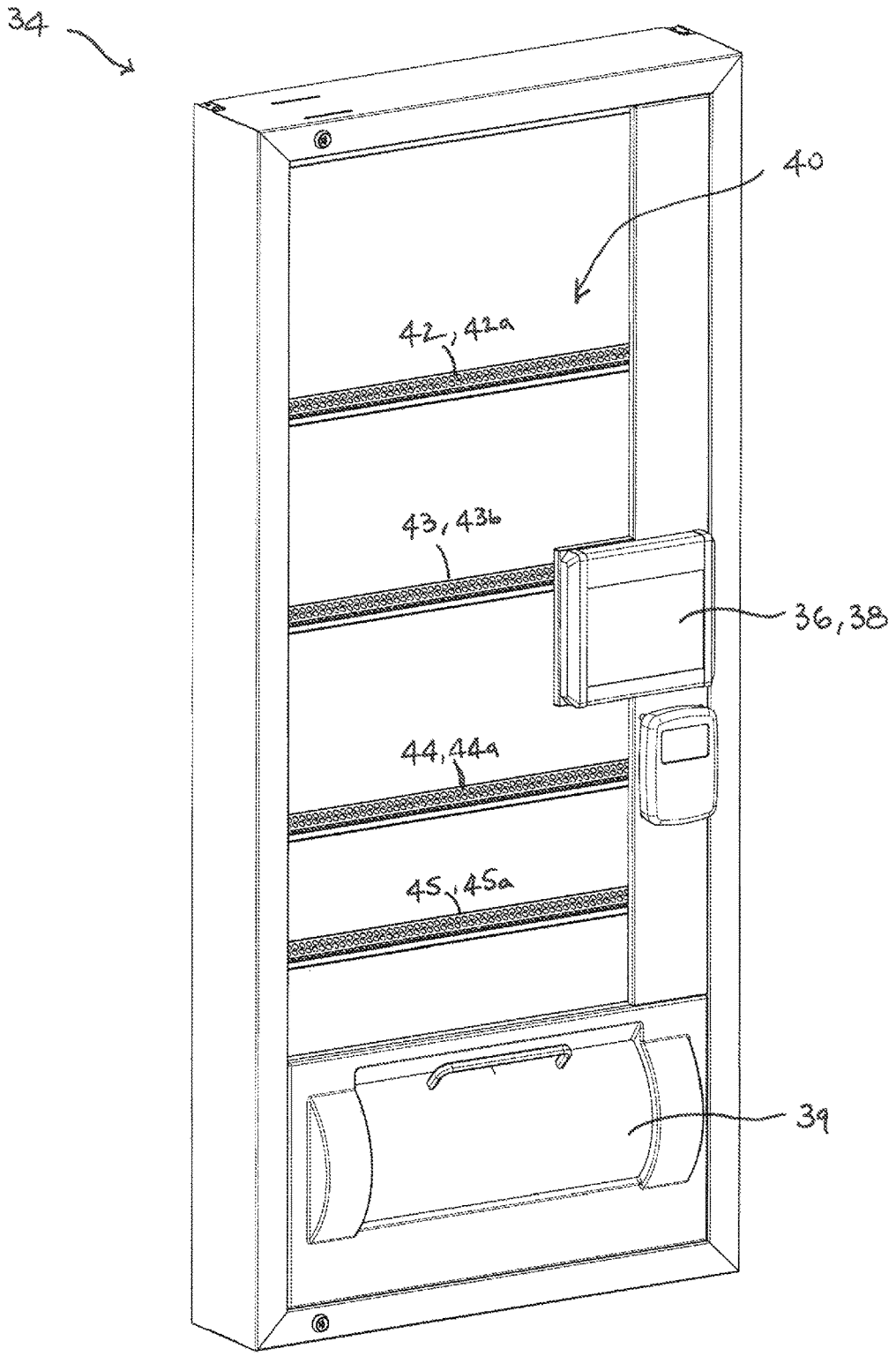
FIG. 2 is an enlarged diagrammatic perspective view of the vending machine door panel shown in FIG. 1*b;*

Referring initially to FIGS. 1*a* and 1*b*, there is shown a vending machine 20 having product storage area 22 in which products 24 are stored at a plurality of vertically spaced product storage locations 26*a-e* which are positioned one above the other. Each vertically spaced product storage location 26*a-e* has an array of substantially horizontal files 28 of the products 24 which extend between the front and rear of the vending machine 20 and which are positioned adjacent to each other across the width of the vending machine 20.

In the illustrated embodiment, the products 24 in each horizontal file 28 are arranged on a product support 30 in the form of a shelf 32*a-e* and the products 24 can be dispensed from each file 28 at the front in any suitable manner. In the illustrated embodiment, a spiral drive is employed to dispense products from the shelf 32*e* and a pusher (not shown) can be used to dispense products 24 from the shelves 32*a-d*. As is conventional in the art, the vending machine 20 includes a door panel 34 to secure the products 24 in the product storage area 22. The door panel 34 includes a selection device 36 in the form of a keypad 38 which enables a customer to select which product(s) 24 they want to purchase and other operational elements, such as a coin slot, card reader, etc. to receive payment for the selected products 24. In order to enable a customer to collect the purchased product(s), the vending machine 20 includes a product collection area 23 which is positioned below the product storage area 22, towards the bottom of the vending machine 20, and the door panel 34 includes an access cover 39 to provide access to the product collection area 23.

Products dispensed from the shelf 32*e* by the spiral drive simply fall into the product collection area 23 in a conventional manner under the influence of gravity. Such products are typically, but not exclusively, confectionery or snack food products. This lower shelf 32*e* with its spiral drive does not, however, form part of the present disclosure and could be omitted entirely.

A product transport mechanism 40 is provided to transport purchased products 24 dispensed from the shelves 32*a-d* in the product storage area 22 to the product collection area 23. The product transport mechanism 40, which in the illustrated embodiment is integrated into the door panel 34, includes a plurality of vertically arranged product transport carriages 42-45. Each product transport carriage 42-45 comprises a substantially horizontal shelf member 42*a*-45*a* which extends across the entire width of the product storage area 22 so that it can receive products 24 dispensed from any one of the files 28 in the product storage area 22. In the illustrated embodiment, each shelf member 42*a*-45*a* is perforated to minimise its weight but the perforations may not always be necessary, particularly if the shelf members 42*a*-45*a* are formed from a lightweight material. Each shelf member 42*a*-45*a* includes front and rear lips provided by inclined portions of the shelf member 42*a*-45*a* which ensure that products 24 dispensed onto the shelf members 42*a*-45*a* from the product storage area 22 cannot fall from the shelf members 42*a*-45*a*.

Each product transport carriage 42-45 includes left mounting members 42*b*-45*b* and right mounting members 42*c*-45*c* on which opposite ends of each of the respective shelf members 42*a*-45*a* are mounted. Each of the left and right mounting members includes a circular opening 56*a*-56*d*. The diameter of the circular openings 56*a-d* decreases progressively from the lowermost product transport carriage 45 to the uppermost product transport carriage 42. Stated another way, the circular openings 56*d* in the left and right mounting members 45*b*, 45*c* of the lowermost product transport carriage 45 have a larger diameter than the circular openings 56*c* in the left and right mounting members 44*b*, 44*c* of the product transport carriage 44 immediately above it, and so on.

The product transport mechanism 40 includes left and right belts 46*a*, 46*b* which may take the form of endless belts as illustrated. The left and right belts 46*a*, 46*b* are oriented so that they are substantially vertical and so that they extend between the top and bottom of the vending machine door panel 34. The left belt 46*a* extends around left upper and lower sprockets 48*a*, 50*a* and the right belt 46*b* extends around right upper and lower sprockets 48*b*, 50*b*. The left and right belts 46*a*, 46*b* include tooth formations (not illustrated) which engage corresponding tooth formations (not illustrated) on the left and right upper sprockets 48*a*, 48*b* and the left and right lower sprockets 50*a*, 50*b*. Typically, the left and right belts 46*a*, 46*b* comprise a chain but other forms of belt could be used as discussed earlier in this specification. In order to synchronise the movement of the left and right sprockets and hence of the left and right belts 46*a*, 46*b*, the left and right upper sprockets 48*a*, 48*b* are mounted at the left and right ends of an upper shaft 52 and the left and right lower sprockets 50*a*, 50*b* are mounted at the left and right ends of a lower shaft 54.

Figure 10:
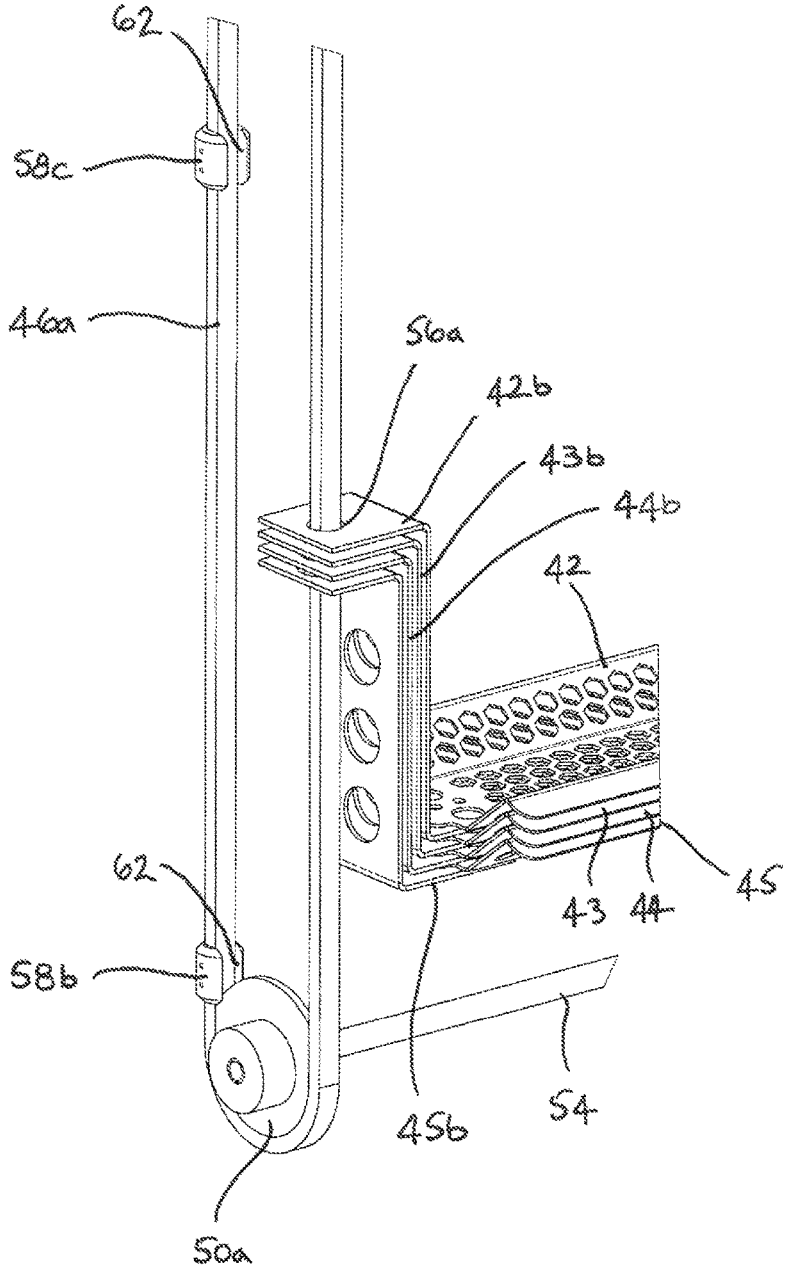
FIG. 10 is an enlarged view of the product transport mechanism in the region of a left lower sprocket.

The left and right belts 46*a*, 46*b* pass freely through the circular openings 56*a-d* in the left and right mounting members 42*b*-45*b*, 42*c*-45*c* of each product transport carriage 42-45 and the movement of the product transport carriages 42-45 is thus controlled by the left and right belts 46*a*, 46*b*. In order to support the product transport carriages 42-45 on the belts 46*a*, 46*b* and to prevent them from sliding down the belts 46*a*, 46*b*, horizontal pairs of carriage support members 58*a-d* are fixed to the belts 46*a*, 46*b* at predetermined vertically spaced positions. The carriage support members 58*a-d* are cylindrical and each pair of carriage support members 58*a-d* has a different diameter, with the diameter of the carriage support members 58*a-d* decreasing progressively from the lowermost pair of carriage support members 58*d* to the uppermost pair of carriage support members 58*a* in the position shown in FIG. 3. Stated another way, the diameter of the lowermost pair of carriage support members 58*d* is larger than the diameter of the carriage support members 58*c*, the diameter of the carriage support members 58*c* is larger than the diameter of the carriage support members 58*b*, and so on. As best seen in FIG. 10, each carriage support member 58*a-d* includes a channel 62 which enables the carriage support members 58*a-d* to travel around the left and right lower sprockets 50*a*, 50*b* (see FIGS. 10 and 11) without fouling the sprockets and jamming the product transport mechanism 40.

Figure 3:
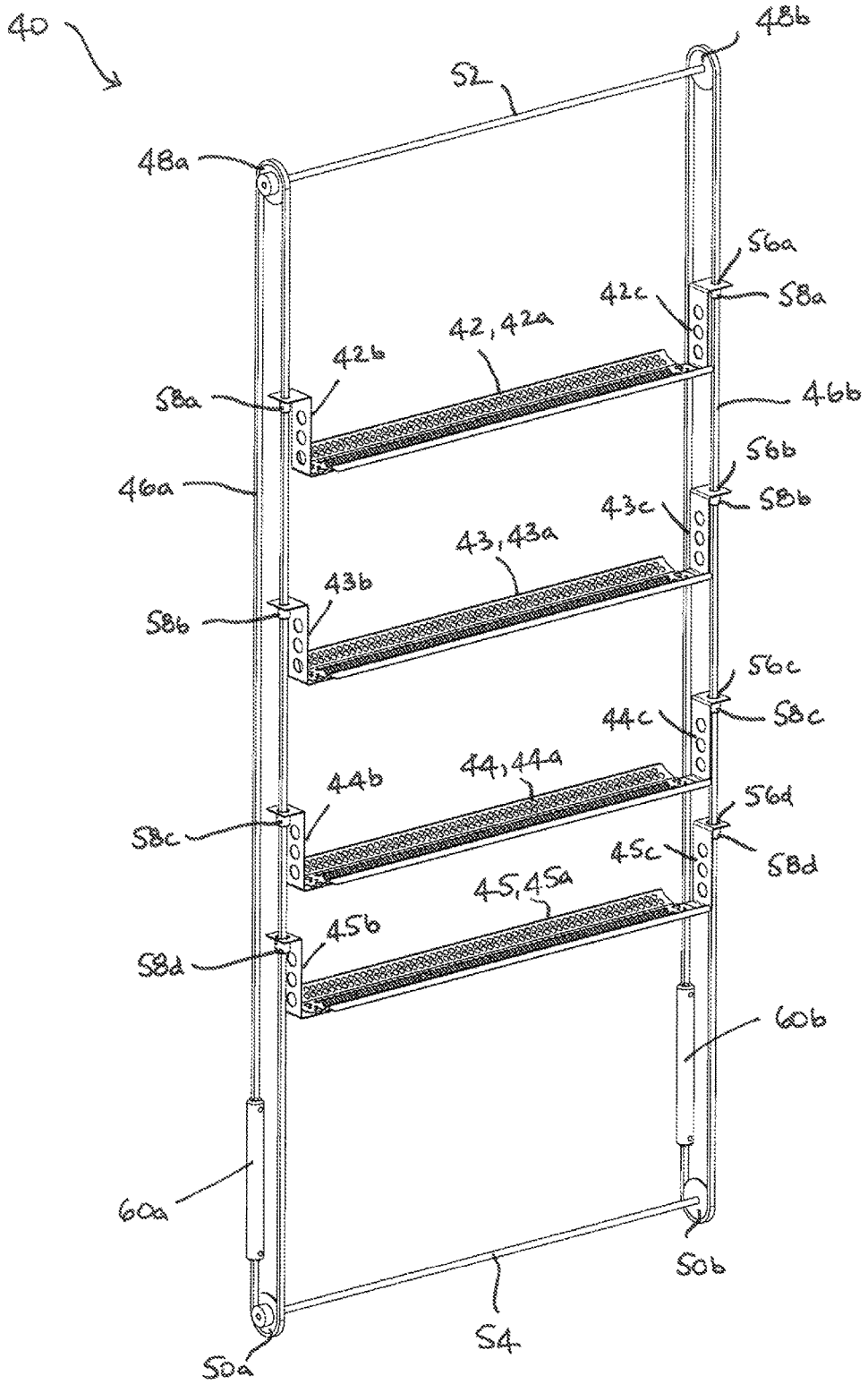
FIGS. 3 to 7 are diagrammatic perspective views of one embodiment of the product transport mechanism showing the product transport carriages in different positions.

Each pair of carriage support members 58*a-d* is arranged to support a predetermined one of the product transport carriages 42-45. The lowermost carriage support members 58*d* are arranged to support the lowermost product transport carriage 45 and the diameter of the carriage support members 58*d* is, therefore, larger than the diameter of the openings 56*d* in the left and right mounting members 45*b*, 45*c* of the lowermost product transport carriage 45. The left and right carriage support members 58*d* cannot, therefore, pass through the left and right openings 56*d* and the product transport carriage 45 sits on the carriage support members 58*d* as shown in FIG. 3. In a similar manner, the carriage support members 58*c* are arranged to support the product transport carriage 44 and the diameter of the carriage support members 58*c* is, therefore, larger than the diameter of the openings 56*c* in the left and right mounting members 44*b*, 44*c* of the product transport carriage 44. The left and right carriage support members 58*c* cannot, therefore, pass through the left and right openings 56*c* and the product transport carriage 44 sits on the carriage support members 58*c*. Similarly, the product transport carriage 43 sits on the carriage support members 58*b* and the product transport carriage 42 sits on the carriage support members 58*a*.

The diameter of the carriage support members 58*a-d* on which each respective product transport carriage 42-45 sits is smaller than the diameter of the openings 56*a-d* in the left and right mounting members 42*b*-45*b*, 42*c*-45*c* of the product transport carriage 42-45 immediately below (and hence smaller than the diameter of the openings 56*a-d* in the left and right mounting members 42*b*-45*b*, 42*c*-45*c* of all of the product transport carriages 42-45 below it because of the increasing diameter of the openings 56*a-d* in the downward direction). For example, the diameter of the carriage support members 58*a* which support the uppermost product transport carriage 42 is smaller than the diameter of the openings

56*b* in the left and right mounting members 43*b*, 43*c* of the next lowest product transport carriage 43 (and, hence, also smaller than the diameter of the openings 56*c*, 56*d* in the left and right mounting members 44*b*, 44*c*, 45*b*, 45*c*). For example, as explained above the uppermost carriage support members 58*a* cannot pass through the openings 56*a* in the uppermost left and right mounting members 42*b*, 42*c* so that they support the uppermost product transport carriage 42 on the left and right belts 46*a*, 46*c*. The uppermost carriage support members 58*a* can, however, pass through the larger diameter left and right openings 56*b*, 56*c*, 56*d* in the left and right mounting members of each of the product transport carriages 43-45. In a similar manner, the carriage support members 58*b* cannot pass through the openings 56*b* in the left and right mounting members 43*b*, 43*c* so that they support the product transport carriage 43 on the left and right belts 46*a*, 46*c*. The carriage support members 58*b* can, however, pass through the larger diameter left and right openings 56*c*, 56*d* in the left and right mounting members of each of the product transport carriages 44, 45 below it. Finally, and again in a similar manner, the carriage support members 58*c* cannot pass through the openings 56*c* in the left and right mounting members 44*b*, 44*c* so that they support the product transport carriage 44 on the left and right belts 46*a*, 46*c*. The carriage support members 58*c* can, however, pass through the larger diameter left and right openings 56*d* in the left and right mounting members 45*b*, 45*c* of the lowermost product transport carriage 45.

In the embodiment illustrated in FIGS. 3 to 11, the product transport mechanism 40 includes counterweights 60*a*, 60*b* which are fitted to a rear portion of each of the left and right belts 46*a*, 46*b*. When the product transport carriages 42-45 are unloaded, the counterweights 60*a*, 60*b* fall to the lowest position on the rear portion of the belts 46*a*, 46*b* (because they are heavier than the unloaded product transport carriages 42-45) and thereby place the belts 46*a*, 46*b* in a configuration in which each of the product transport carriages 42-45 adopts a first position (determined by the vertical positions of the carriage support members 58*a-d*) in which it is substantially vertically aligned with a predetermined one of the shelves 32*a-d* defining the vertically spaced product storage locations 26 (see FIG. 1*a*). When each of the product transport carriages 42-45 is in its first position, each product transport carriage 42-45 can receive a product 24 dispensed from the predetermined shelf 32*a-d* with which it is vertically aligned. Specifically, when the product transport carriage 42 is in its first position, it is vertically aligned with, and can receive a product 24 dispensed from, the shelf 32*a*; when the product transport carriage 43 is in its first position, it is vertically aligned with, and can receive a product 24 dispensed from, the shelf 32*b*; when the product transport carriage 44 is in its first position, it is vertically aligned with, and can receive a product 24 dispensed from, the shelf 32*c*; and when the product transport carriage 45 is in its first position, it is vertically aligned with, and can receive a product 24 dispensed from, the shelf 32*d*.

The product transport carriages 42-45 are movable in the same vertical plane and each product transport carriage 42-45 can move from its respective first position in vertical alignment with the predetermined shelf 32*a-e* in the product storage area 22 to a second position in the product collection area 23, thereby transporting a dispensed product 24 from the product storage area 22 to the product collection area 23.

FIGS. 4 to 7 show each successive product transport carriage 42-45, from the lowermost 45 to the uppermost 42, in the second position.

Figure 4:
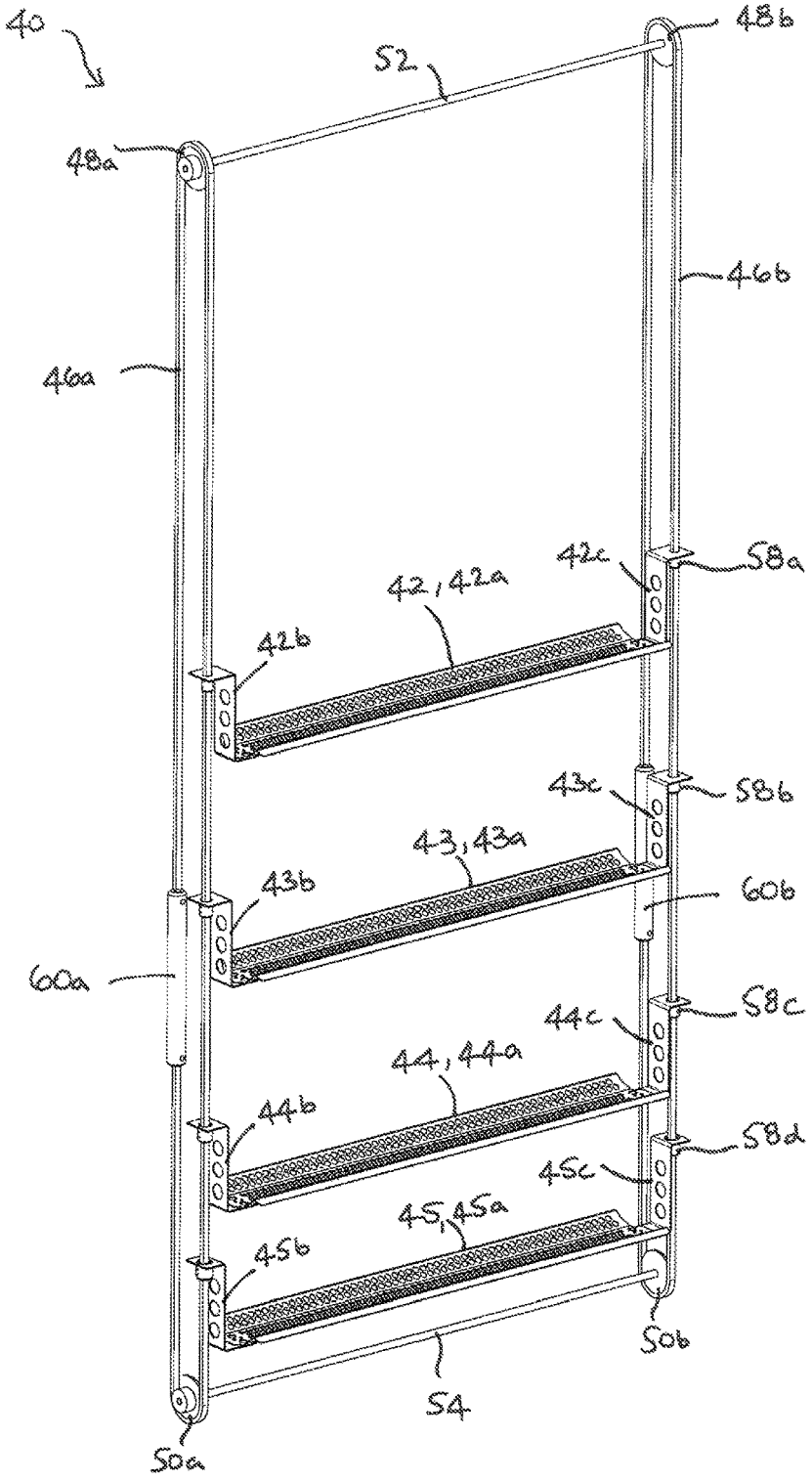

Referring initially to FIG. 4, the lowermost product transport carriage 45 has moved from its first position shown in FIG. 3 to the second position thereby transporting a product (not shown) dispensed from the shelf 32*d* in the product storage area 22 to the product collection area 23. In more detail, when a product 24 is dispensed from the shelf 32*d* onto the product transport carriage 45, the weight of the dispensed product 24 (which is greater than the weight of the counterweights 60*a*, 60*b*) overcomes the force applied by the counterweights 60*a*, 60*b* to the product transport carriage 45 through the left and right belts 46*a*, 46*b* and the carriage support members 58*d*. The product transport carriage 45 thus descends to the second position in the product collection area 23 thereby enabling a customer to retrieve the product 22. The movement of the product transport carriage 45, as well as the movement of the product transport carriages 42-44 above it, is controlled by the belts 46*a*, 46*b*. As the product transport carriage 45 moves downwardly into the product collection area 23, the product transport carriages 42-44 also move downwardly by a short distance from their respective first positions due to the movement of the belts 46*a*, 46*b* and hence the carriage support members 58*a-c*. As soon as the product 24 has been removed from the product transport carriage 45, the counterweights 60*a*, 60*b* descend to their original position shown in FIG. 3 and thereby return each of the product transport carriages 42-45 to their respective first positions due to the fact that each of the product transport carriages 42-45 is supported by its respective carriage support members 58*a*-58*d*.

Figure 5:
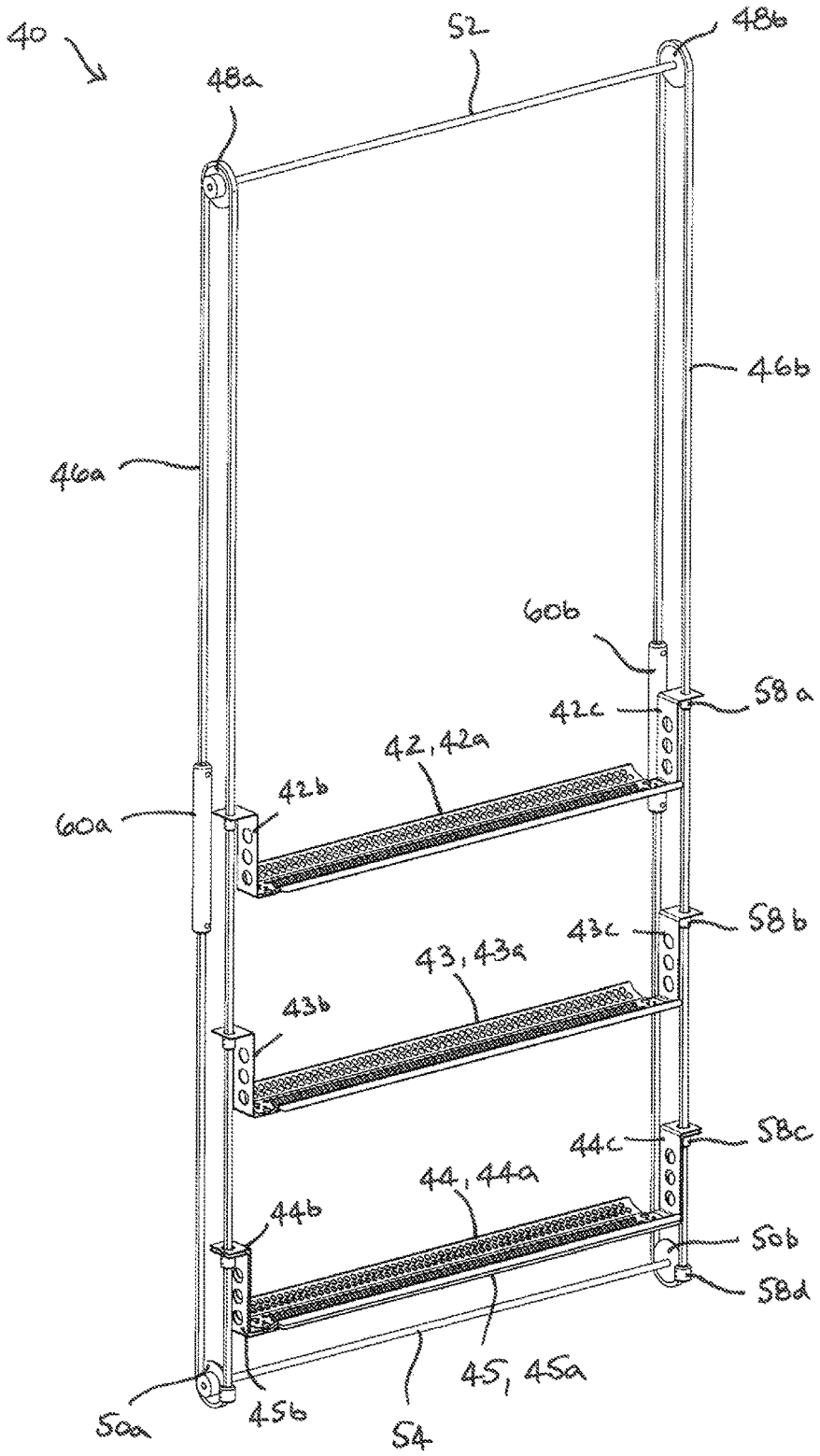
Figure 8:
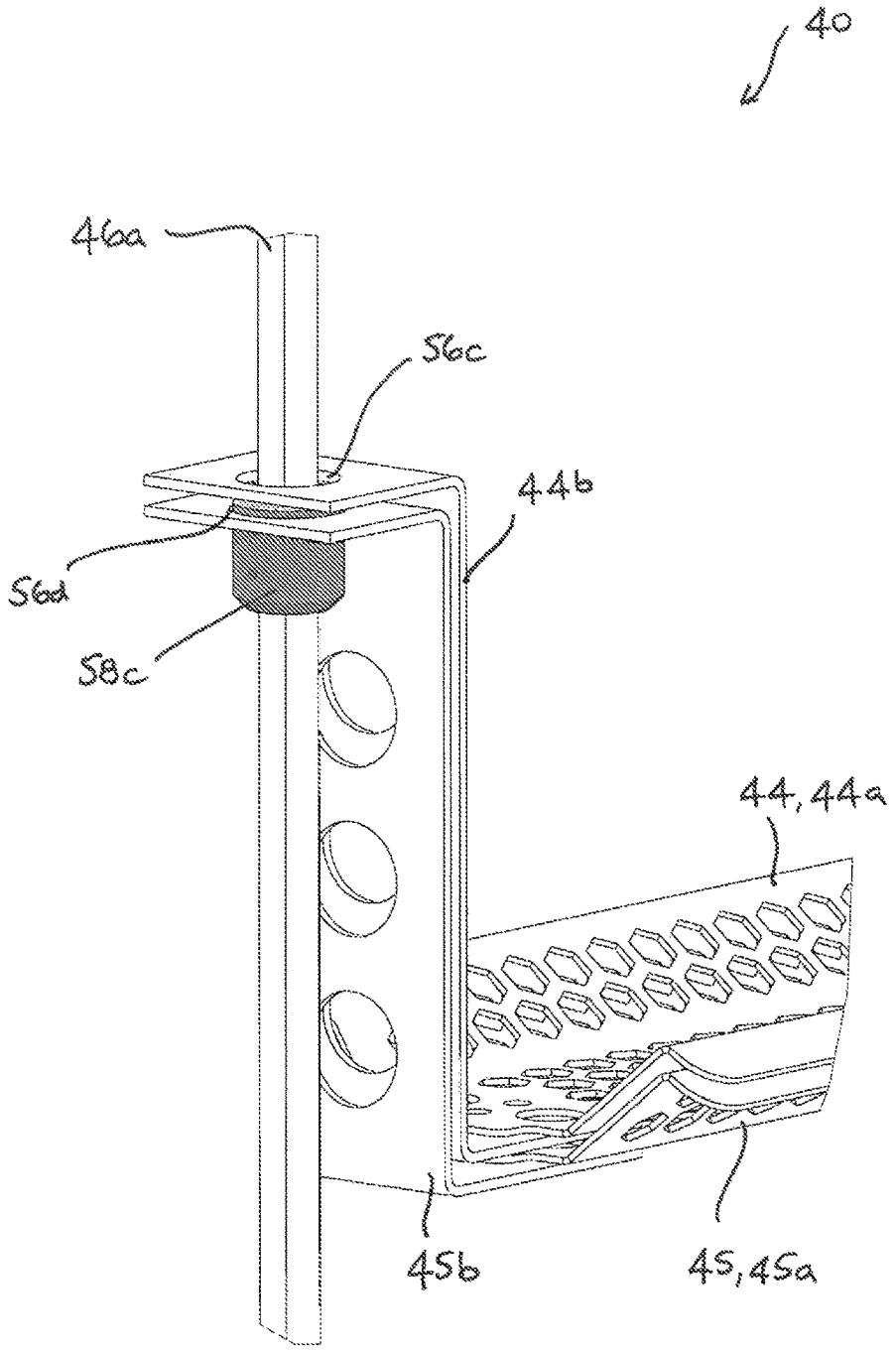
FIGS. 8 and 9 are enlarged views of part of the product transport mechanism according to embodiments of the present disclosure showing the cooperation between the product transport carriages and the carriage support members when the product transport carriages are nested together in a second position.

Referring now to FIGS. 5 and 8, it will be seen that the product transport carriage 44 has moved from its first position shown in FIG. 3 to the second position thereby transporting a product (not shown) dispensed from the shelf 32*c* in the product storage area 22 to the product collection area 23. In more detail, when a product 24 is dispensed from the shelf 32*c* onto the product transport carriage 44, the weight of the dispensed product 24 overcomes the force applied by the counterweights 60*a*, 60*b* to the product transport carriage 44 through the left and right belts 46*a*, 46*b* and the carriage support members 58*c*. The product transport carriage 44 thus moves downwardly and at the same time, the other product transport carriages 42, 43, 45 also move downwardly. Initially, the lowermost product transport carriage 45 reaches the second position in the product collection area 23. At this point, the lowermost product transport carriage 45 cannot descend any further and it is supported in the product collection area 23. The belts 60*a*, 60*b* continue to move and the carriage support members 58*d* supporting the lowermost product transport carriage 45 pass around the left and right lower sprockets 50*a*, 50*b* (due to the presence of the channel 62) thereby enabling the front portion of each of the left and right belts 60*a*, 60*b* to continue moving downwardly until the product transport carriage 44 reaches the second position in the product collection area 23 so that a customer can retrieve the vended product 22. As can be clearly seen in FIGS. 5 and 8, the product transport carriages 44, 45 are configured and dimensioned so that they nest with each other when they are in the second position in the product collection area 23. In order to facilitate nesting of the product transport carriages 44, 45 as shown in FIGS. 5 and 8, as the product transport carriage 44 arrives at the second position, the carriage support members 58*c* which support it pass freely through the larger diameter openings 56*d* in the mounting members 45*b*, 45*c* of the lowermost product transport carriage 45 (best seen in FIG. 8). Once again, it will be appreciated that the movement of the product transport carriages 42-45 is controlled by the belts 46*a*, 46*b* and that the counterweights 60*a*, 60*b* act to return the product transport carriages 42-45 to their respective first positions once the vended product has been removed by a customer from the product transport carriage 44.

Figure 6:
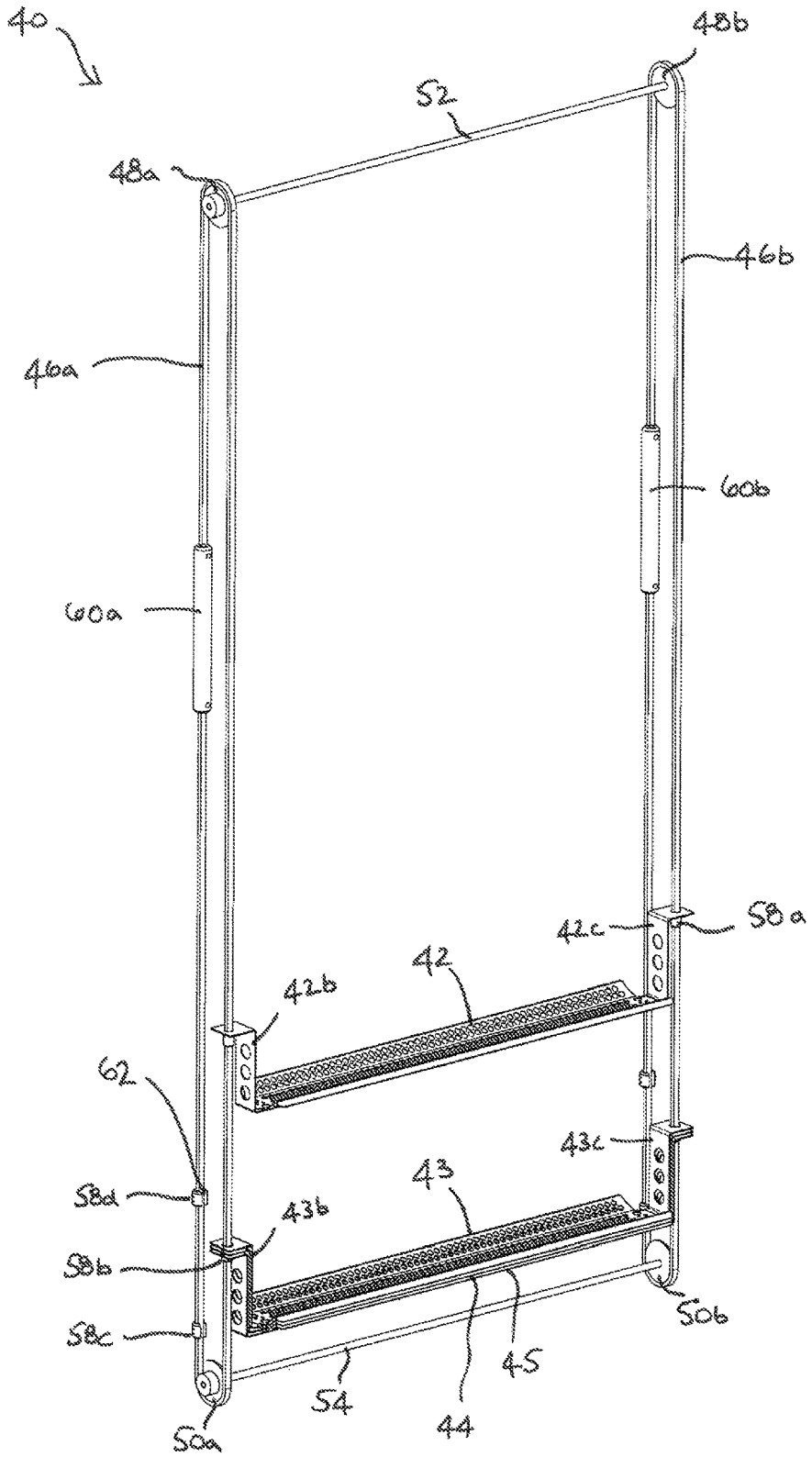
Figure 9:
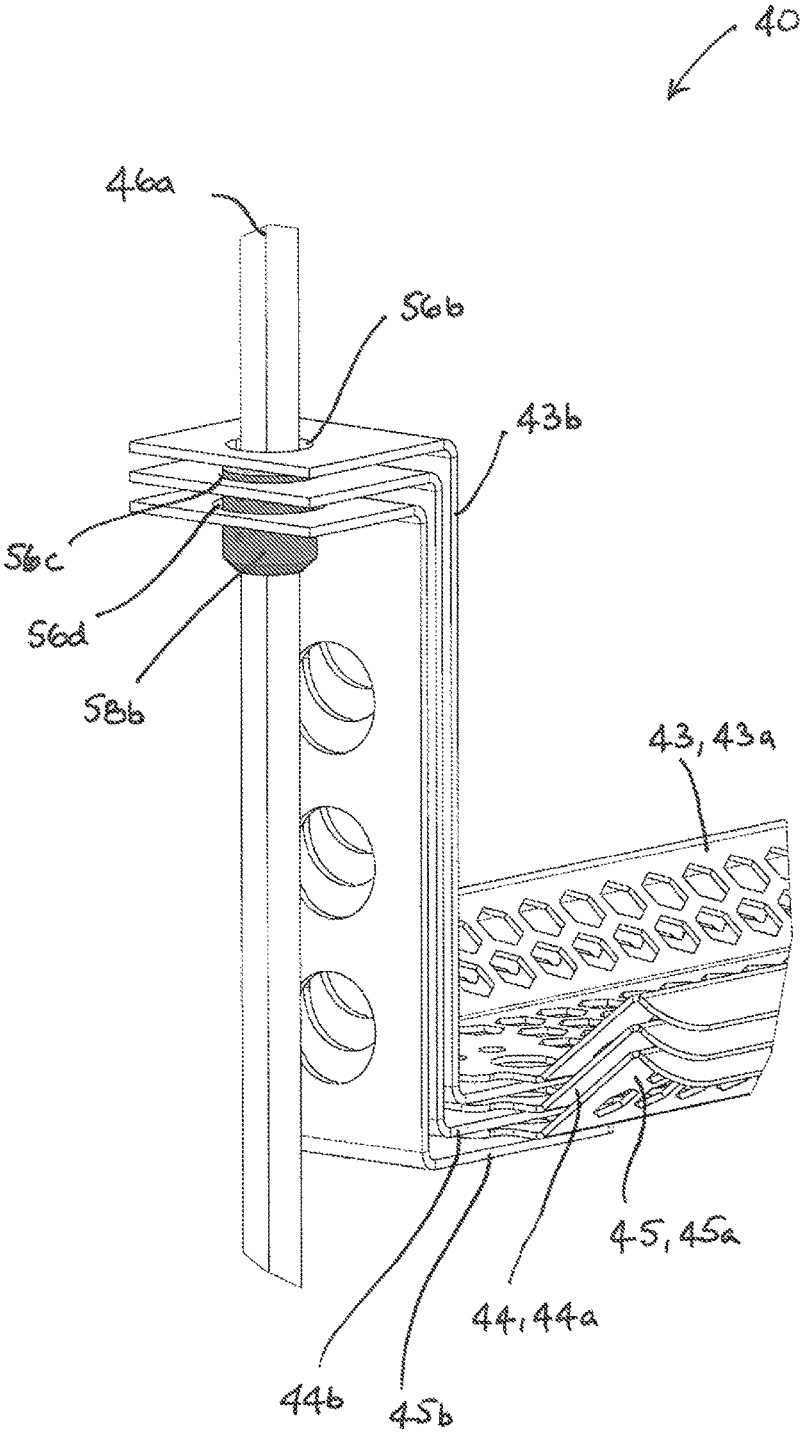

Referring now to FIGS. 6 and 9, it will be seen that the product transport carriage 43 has moved from its first position shown in FIG. 3 to the second position thereby transporting a product (not shown) dispensed from the shelf 32*b* in the product storage area 22 to the product collection area 23. In more detail, when a product 24 is dispensed from the shelf 32*b* in the product storage area 22 onto the product transport carriage 43, the weight of the dispensed product 24 overcomes the force applied by the counterweights 60*a*, 60*b* to the product transport carriage 43 through the left and right belts 46*a*, 46*b* and the carriage support members 58*b*. The product transport carriage 43 thus moves downwardly and at the same time, the other product transport carriages 42, 44, 45 also move downwardly. Initially, the product transport carriages 45 and 44 sequentially reach the second position where they nest together in the product collection area 23 (as already described above with reference to FIGS. 5 and 8) and cannot descend any further. The belts 60*a*, 60*b* continue to move until the product transport carriage 43 reaches the second position in the product collection area 23 where it nests with the product transport carriage 44 immediately below it. In order to facilitate nesting of the product transport carriages 43, 44 as shown in FIGS. 5 and 9, as the product transport carriage 43 arrives at the second position, the carriage support members 58*b* which support it pass freely through the larger diameter openings 56*c*, 56*d* in the left mounting members 44*b*, 45*b* and the right mounting members 44*c*, 45*c* of the product transport carriages 44, 45 (best seen in FIG. 9). Yet again, it will be appreciated that the movement of the product transport carriages 42-45 is controlled by the belts 46*a*, 46*b* and that the counterweights 60*a*, 60*b* act to return the product transport carriages 42-45 to their respective first positions once the vended product has been removed by a customer from the product transport carriage 43.

Figure 7:
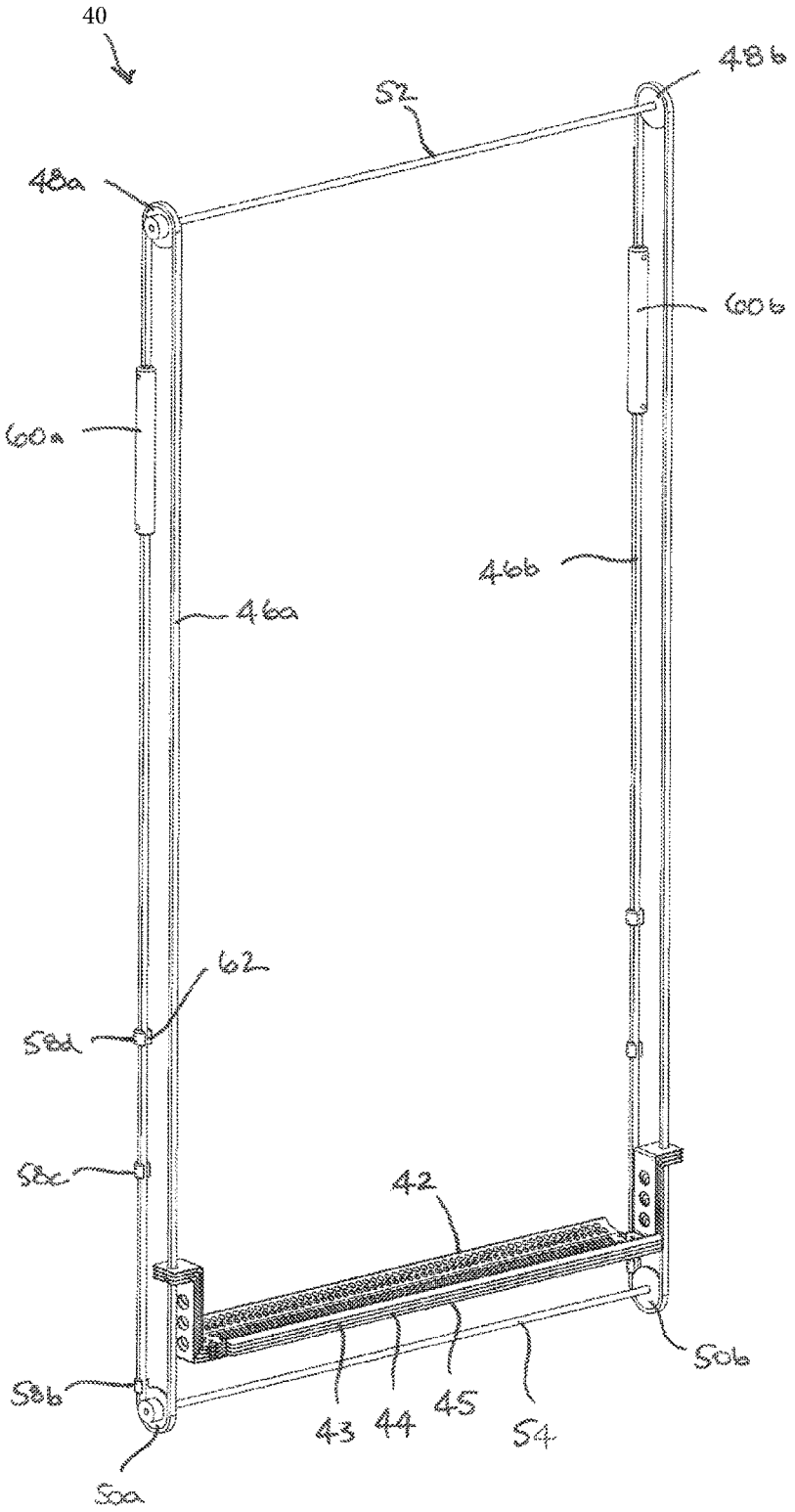

It will be understood that the principle described above can be extended to the configuration shown in FIG. 7 in which the uppermost product transport carriage 42 has transported a product (not shown) to the second position in the product collection area 23 and in which all of the product transport carriages 42-45 are nested together in the product collection area 23.

Figure 11:
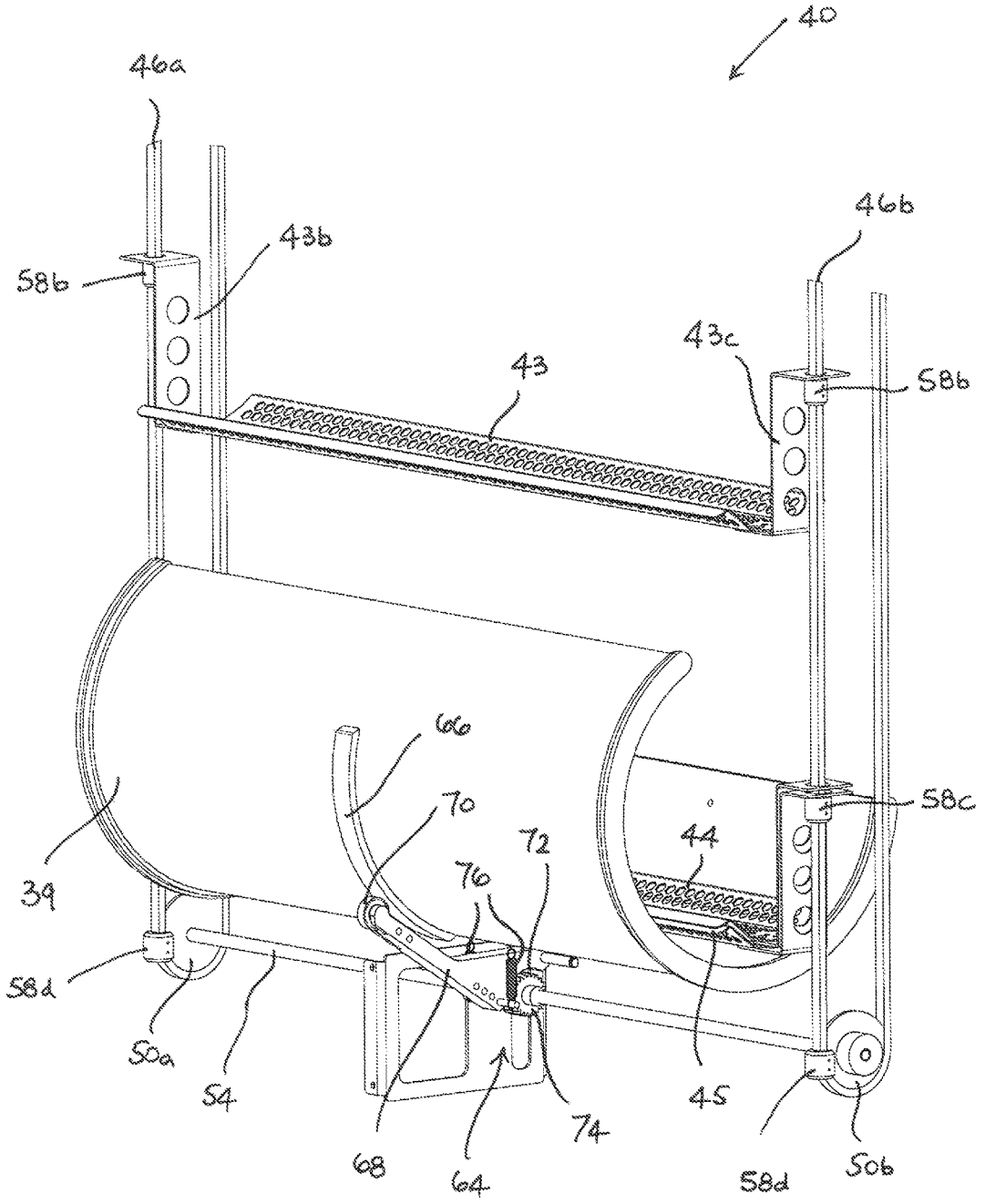
FIG. 11 is an enlarged view of a lower part of one embodiment of the product transport mechanism showing the detail of a braking mechanism.

Referring now to FIG. 11, the access cover 39 is semi-cylindrical and can be rotated between a closed position (shown in FIGS. 1*a*, 1*b*, 2 and 11) in which it prevents access to the product collection area 23 and an open position in which it allows access to the product collection area 23 so that a customer can collect a product from one of the product transport carriages 42-45 when it has moved to the second position. When the access cover 39 is moved to the open position, it operates a braking mechanism 64 which prevents movement of the product transport carriages 42-45. In more detail, the access cover 39 includes a rib 66 extending circumferentially around its outer surface roughly mid-way between the ends of the access cover 39. The braking mechanism 64 includes an arm 68 which at a first end includes a rotatable member 70 such as a bearing in rolling contact with the rib 66. The second end of the arm 68 includes a first braking element 72 which can frictionally engage a second braking element 74 mounted on the lower shaft 54. In the illustrated embodiment, the first braking element 72 comprises a curved surface at the second end of the arm 68 and the second braking element 74 comprises a sprocket. Other forms of braking element 72, 74 are, however, entirely within the scope of the present disclosure.

The braking mechanism 64 includes biasing means 76 in the form of springs which bias the arm 68 upwardly. When the access cover 39 is in the closed position, the arm 68 is biased upwardly so that the first and second braking elements 72, 74 are disengaged. The lower shaft 54 can, thus, rotate freely and the product transport carriages 42-45 can move vertically between the first and second positions in the manner described above. When the access cover 39 is rotated by a customer from the closed position to the open position, the cooperation between the rib 66 and the rotatable member 70 moves the arm 68 downwardly thereby urging the first braking element 72 into frictional engagement with the second braking element 74. This frictional engagement prevents rotation of the lower shaft 54 and the belts 60*a*, 60*b*. This means that the product transport carriages 42-45 cannot ascend to their respective first positions as soon as a product 24 has been removed from the product transport carriage 42-45 which is in the second position. As soon as the access cover 39 is moved from the open position to the closed position, the biasing means 76 can urge the arm 68 upwardly and thereby disengage the first and second braking elements 72, 74. The product transport carriages 42-45 can then ascend to their respective first positions under the action of the counterweights 60*a*, 60*b*.

In order to retard the vertical movement of the product transport carriages 42-45, for example from the first position to the second position when a product has been dispensed onto one of the product transport carriages 42-45 or from the second position to the first position under the action of the counterweights 60*a*, 60*b* when the access cover 39 has been moved from the open position to the closed position, the product transport mechanism 40 includes a damping mechanism (not shown). The damping mechanism typically acts on the upper shaft 52, and more particularly on one of the upper sprockets 48*a*, 48*b*, but the damping mechanism could act on a different part of the product transport mechanism 40.

Figure 12:
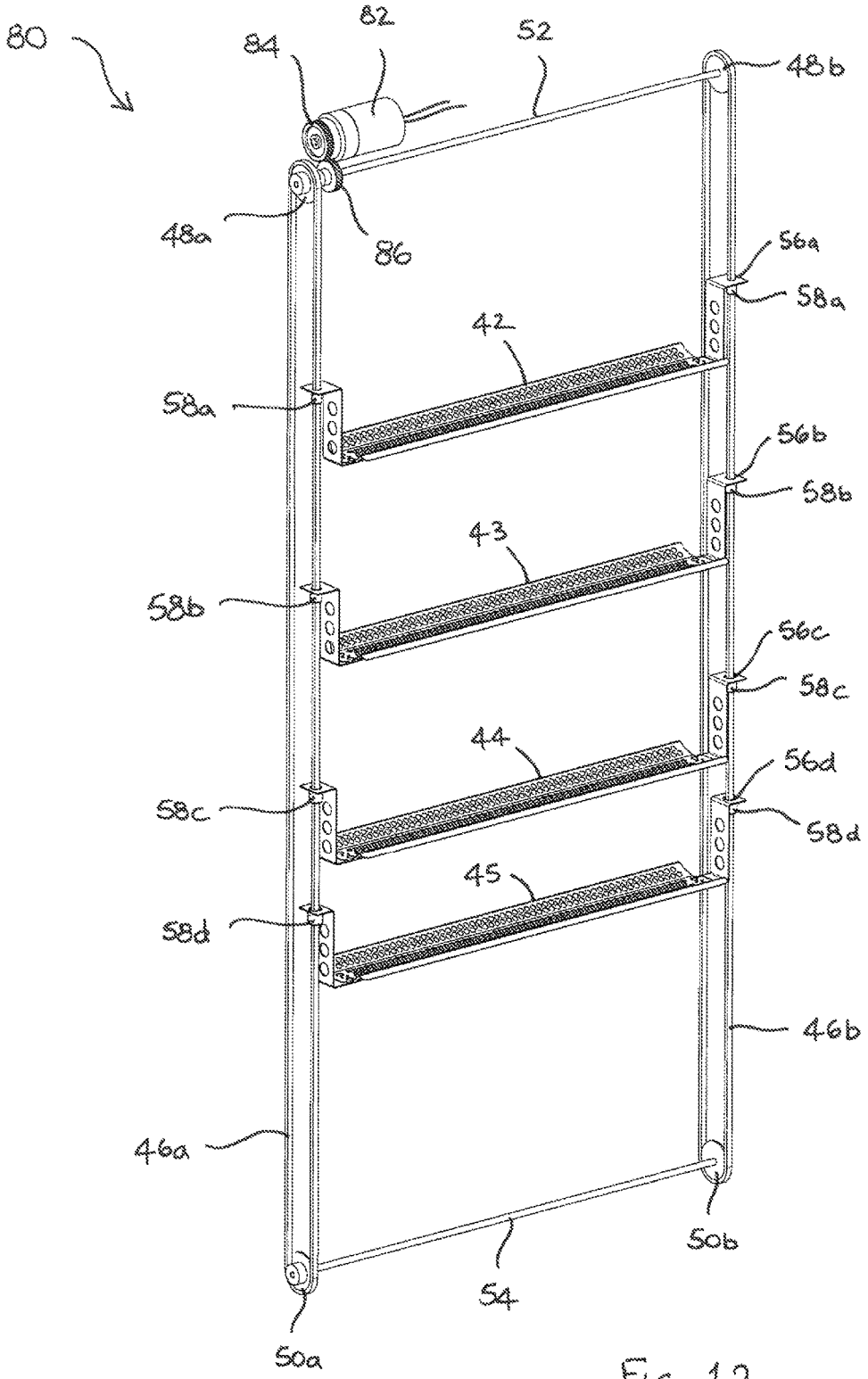
FIG. 12 is a diagrammatic perspective view of another embodiment of the product transport mechanism.

An alternative embodiment of the product transport mechanism 80 is illustrated in FIG. 12. The product transport mechanism 80 shares many features in common with the product transport mechanism 40 described with reference to FIGS. 1 to 11 and corresponding features are, therefore, identified using corresponding reference numerals. In this alternative embodiment, the movement of the left and right belts 46*a*, 46*b* is not controlled by counterweights. Instead, the product transport mechanism 80 includes a motorised drive unit in the form of an electric drive motor 82 to control the movement of the left and right belts 46*a*, 46*b* and, hence, to control the movement of the product transport carriages 42-45 between the first and second positions.

In the illustrated embodiment, the electric drive motor 82 drives the upper shaft 52 but it should be understood that it could easily drive the lower shaft 54. In particular, a rotating toothed wheel 84 on the motor 82 engages a toothed wheel 86 fixed to the upper shaft 52. When the motor 82 is operated to rotate the toothed wheel 84, the toothed wheel 86 is correspondingly rotated and this causes the belts 46*a*, 46*b*, and hence the product transport carriages 42-45, to move between the first and second positions so that the appropriate one or more of the product transport carriages 42-45 is conveyed from the first position to the second position in the product collection area 23 and so that the product transport carriages 42-45 are subsequently returned to their respective first positions. Although not shown, a motor control unit would be provided to control the operation of the electric drive 82.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments. Each feature disclosed in the specification, including the claims and drawings, may be replaced by alternative features serving the same, equivalent or similar purposes, unless expressly stated otherwise.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

Any combination of the above-described features in all possible variations thereof is encompassed by the present invention unless otherwise indicated herein or otherwise clearly contradicted by context.

What is claimed is:

1. A product transport mechanism for a vending machine having a product storage area comprising a plurality of vertically spaced product storage locations and a product collection area, the product transport mechanism comprising:

a plurality of vertically arranged product transport carriages each of which is movable in a vertical plane between: a first position in which the product transport carriage is arranged to receive a product dispensed from a predetermined one of the vertically spaced product storage locations; and a second position below the first position in which the product transport carriage is located in the product collection area to enable collection of the product by a customer from the product transport carriage, wherein the vertical plane of each product transport carriage is the same;

wherein the product transport carriages are configured and dimensioned so that they nest with each other when they are in the second position in the product collection area; and wherein the product transport mechanism comprises left and right substantially vertically extending belts at each end of the product transport carriages for controlling the movement of the product transport carriages between the first and second positions.

2. A product transport mechanism according to claim 1, wherein each product transport carriage includes front and rear lips to retain a product thereon.

3. A product transport mechanism according to claim 1, wherein each product transport carriage extends in use across the product storage area.

4. A product transport mechanism according to claim 1, wherein each product transport carriage comprises a substantially horizontal shelf member.

5. A product transport mechanism according to claim 1, wherein each of the left and right belts extends respectively around left upper and lower sprockets and right upper and lower sprockets.

6. A product transport mechanism according to claim 5, wherein the left and right upper sprockets are mounted at opposite ends of an upper shaft and the left and right lower sprockets are mounted at opposite ends of a lower shaft.

7. A product transport mechanism according to claim 1, wherein each product transport carriage includes left and right openings at its left and right ends through which the respective left and right belts pass freely.

8. A product transport mechanism according to claim 7, wherein each of the left and right openings in each product transport carriage is larger than the corresponding left and right openings in the product transport carriage immediately above it.

9. A product transport mechanism according to claim 1, wherein horizontal pairs of vertically spaced carriage support members are fixed to the left and right belts and each horizontal pair of left and right carriage support members is positioned below a predetermined one of the product transport carriages to support the product transport carriage on the left and right belts and prevent it from sliding downwardly along the belts.

10. A product transport mechanism according to claim 9, wherein each horizontal pair of left and right carriage support members is fixed to the left and right belts at a predetermined vertical position whereby each of the product transport carriages can be simultaneously substantially vertically aligned with a predetermined one of the vertically spaced product storage locations to receive a product dispensed therefrom.

11. A product transport mechanism according to claim 9, wherein each horizontal pair of left and right carriage support members is larger than the corresponding left and right openings in the predetermined product transport carriage which is supported by the carriage support members.

12. A product transport mechanism according to claim 9, wherein the horizontal pair of left and right carriage support members supporting a product transport carriage are smaller than the corresponding left and right openings in the product transport carriages below the product transport carriage supported by said horizontal pair of left and right carriage support members.

13. A product transport mechanism according to claim 9, wherein each carriage support member includes a channel to enable it to pass around the lower sprockets during movement of the left and right belts around the lower sprockets.

14. A product transport mechanism according to claim 1, wherein each of the product transport carriages adopts its respective first position when the product transport carriages are unloaded.

15. A product transport mechanism according to claim 14, wherein each of the left and right belts includes a counterweight and the counterweights are arranged to move the left and right belts to position each of the product transport carriages in its respective first position when the product transport carriages are unloaded.

16. A product transport mechanism according to claim 15, wherein the product transport mechanism includes a damper arrangement to retard the movement of the product transport carriages between the first and second positions.

17. A vending machine door panel comprising the product transport mechanism of claim 1.

18. A vending machine door panel according to claim 17, further comprising an access cover which is movable between a closed position and an open position to allow a customer to access the product collection area to retrieve a product from a product transport carriage in the second position and a braking mechanism which is operable to prevent movement of the product transport carriages when the access cover is in the open position.

19. A vending machine having a product storage area comprising a plurality of vertically spaced product storage locations and a product collection area located below the product storage area for collection of a vended product by a customer, wherein the vending machine includes a product transport mechanism comprising:

a plurality of vertically arranged product transport carriages each of which is movable in a vertical plane between: a first position in which the product transport carriage is arranged to receive a product dispensed from a predetermined one of the vertically spaced product storage locations; and a second position below the first position in which the product transport carriage is located in the product collection area to enable collection of the vended product by a customer from the product transport carriage, wherein the vertical plane of each product transport carriage is the same;

wherein the product transport carriages are configured and dimensioned so that they nest with each other when they are in the second position in the product collection area; and wherein the product transport mechanism comprises left and right substantially vertically extending belts at each end of the product transport carriages for controlling the movement of the product transport carriages between the first and second positions.

20. A vending machine according to claim 19, wherein each product transport carriage is substantially vertically aligned with a predetermined one of the vertically spaced product storage locations when each product transport carriage is in its first position.

21. A vending machine according to claim 19, further comprising an access cover which is movable between a closed position and an open position to allow a customer to access the product collection area to retrieve a product from a product transport carriage in the second position and a braking mechanism which is operable to prevent movement of the product transport carriages when the access cover is in the open position.

* * * * *